US007271694B2

(12) United States Patent
Chang

(10) Patent No.: US 7,271,694 B2
(45) Date of Patent: Sep. 18, 2007

(54) STRUCTURE OF TRANSFORMER

(75) Inventor: Shih-Hsien Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/297,934

(22) Filed: Dec. 9, 2005

(65) Prior Publication Data

US 2007/0052513 A1 Mar. 8, 2007

(30) Foreign Application Priority Data

Sep. 6, 2005 (TW) ..... 94130597 A

(51) Int. Cl.
*H01F 27/30* (2006.01)

(52) U.S. Cl. ..... 336/208; 336/212; 336/198

(58) Field of Classification Search ..... 336/208, 336/198, 212, 192
See application file for complete search history.

(56) References Cited

U.S. PATENT DOCUMENTS 4,857,878 A * 8/1989 Eng et al. ..... 336/192
5,534,839 A * 7/1996 Mackin et al. ..... 336/192
5,673,013 A * 9/1997 Moody et al. ..... 336/192
6,344,786 B1 * 2/2002 Chin ..... 336/198
6,587,023 B2 * 7/2003 Miyazaki et al. ..... 336/83
6,630,880 B2 * 10/2003 Cheung et al. ..... 336/198

* cited by examiner

*Primary Examiner*—Anh Mai

(57) ABSTRACT

A transformer includes a first winding member, a second winding member, a primary winding coil, a secondary winding coil and a magnetic core assembly. The first winding member has a first channel penetrating therethrough. The second winding member has a second channel penetrating therethrough and includes a covering part. The covering part has a receptacle communicating with the second channel. The primary winding coil is wound on the first winding member. The secondary winding coil is wound on the second winding member. The magnetic core assembly is partially embedded into the first and the second channels. The combination of the first winding member and the primary winding coil wound on the first winding member is accommodated within the receptacle, such that the primary winding coil and the secondary winding coil are separated from each other by the covering part and the first channel communicates with the second channel.

20 Claims, 9 Drawing Sheets

STRUCTURE OF TRANSFORMER

FIELD OF THE INVENTION

The present invention relates to a structure of a transformer, and more particularly to a structure of a transformer having increased leakage inductance.

BACKGROUND OF THE INVENTION

A transformer has become an essential electronic component for various kinds of electric appliance. Referring to FIG. 1, a schematic exploded view of a conventional transformer is illustrated. The transformer 1 principally comprises a magnetic core assembly 11, a bobbin 12, a primary winding coil 13 and a secondary winding coil 14. The primary winding coil 13 and the secondary winding coil 14 are wounded around the bobbin 12. A tape 15 is provided for isolation and insulation. The magnetic core assembly 11 is generally shaped as an EE-type core, a UU-type core, an EI-type core or an ER-type core. The middle portions 111 of the core 11 are embedded into the cylinder tube 121 of the bobbin 12. The primary winding coil 13 and the secondary winding coil 14 interact with the magnetic core assembly 11 to achieve the purpose of voltage regulation.

Since the leakage inductance of the transformer has an influence on the electric conversion efficiency of a power converter, it is very important to control leakage inductance.

Related technologies were developed to increase coupling coefficient and reduce leakage inductance of the transformer so as to reduce power loss upon voltage regulation. In the transformer of FIG. 1, the primary winding coil 13 and the secondary winding coil 14 are superimposed with each other and wounded around the bobbin 12. As a consequence, there is less magnetic flux leakage generated from the primary winding coil 13 and the secondary winding coil 14. Under this circumstance, sine the coupling coefficient is increased, the leakage inductance of the transformer is reduced and the power loss upon voltage regulation is reduced, the electric conversion efficiency of a power converter is enhanced.

In the power supply system of the electric products for the new generation, for example LCD televisions, the transformer with leakage inductance prevails. The current generated from the power supply system will pass through a LC resonant circuit composed of an inductor L and a capacitor C. The inductor L is provided from the primary winding coil of the transformer. Meanwhile, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch and minimize the noise.

In order to increase the leakage inductance of the transformer, the primary winding coil should be separated from the secondary winding coil by a certain distance to reduce the coupling coefficient of the transformer. Referring to FIG. 2, a schematic exploded view of a transformer with leakage inductance according to prior art is illustrated. The transformer 2 principally comprises a bobbin 21, a primary winding coil 22 and a secondary winding coil 23. The bobbin 21 comprises a first side plate 211, a second side plate 212 and a winding member 213. A tape 24 is wound around the middle portion of the winding member 213 and has a width d. The winding member 213 is divided into a first winding section 2131 and a second winding section 2132, which are located at bilateral sides of the tape 24. The primary winding coil 22 and the secondary winding coil 23 are wound around the first winding section 2131 and the second winding section 2132, respectively. The first winding section 2131 is separated from the first side plate 211 by wrapping a first side tape 25 on the winding member 213 between the first winding section 2131 and the first side plate 211. Likewise, the second winding section 2132 is separated from the second side plate 212 by wrapping a second side tape 26 on the winding member 213 between the second winding section 2132 and the second side plate 212. For safety regulations, the tape 24 is used for isolation between the primary winding coil 22 and the secondary winding coil 23. Via the first side tape 25 and the second side tape 26, the primary winding coil 22 and the secondary winding coil 23 are electrically isolated from the conductors outside the transformer 2. As the width d of the tape 24 between the primary winding coil 22 and the secondary winding coil 23 is increased, the coupling coefficient is reduced and the leakage inductance of the transformer is increased. Under this circumstance, the resonant circuit of the power supply system will be conveniently controlled.

Although the transformer structure of FIG. 2 is advantageous for increasing the leakage inductance, some drawbacks still exist. As previously described, the magnitude of the leakage inductance is dependent on the width d of the tape 24 between the primary winding coil 22 and the secondary winding coil 23. Since the tape 24 is made of flexible material and fails to be firmly fixed, the structure of the transformer is readily distorted due to a long-term using period or serious vibration. Under this circumstance, the magnitude of the leakage inductance is reduced or unstable, and the resonant circuit of the power supply system will be adversely affected. Since these tapes are sticky and narrow in width, the procedures of wrapping the tape 24, the first side tape 25 and the second side tape 26 are labor-intensive and complicated. In addition, if the wrapping result is unsatisfied, the electrical performance of the transformer is impaired.

Since the tape 24, the first side tape 25 and the second side tape 26 are wrapped on the winding member 213 of the bobbin 21, the remaining area or volume for winding the primary winding coil 22 and the secondary winding coil 23 around the winding member 213 is limited and thus the heat-dissipating effect is usually insufficient. Furthermore, after the procedures of winding the coils and wrapping the tapes, a layer of insulating tape is additionally wrapped around the primary winding coil 22 and the secondary winding coil 23. The insulating tape also impairs heat dissipation of the transformer during operation. Moreover, since the melting point of the tape 24 is relatively lower, the operating temperature of the transformer is restricted by the melting point of the tape 24.

With increasing development of electronic technologies, the electric conversion efficiency of a power converter to be used in an electronic product is gradually demanding. For example, in a case that a voltage is intended to be converted from a low voltage (e.g. 400V) to a high voltage (e.g. 2,000V), for meeting the requirement of safety regulations, the distance between the primary winding coil and the secondary winding coil should be increased to avoid conduction between the primary winding coil and the secondary winding coil. Unfortunately, since the width d of the tape 24 is insufficient and the converted voltage is too high, the conduction between the primary winding coil and the secondary winding coil is possible.

In views of the above-described disadvantages, the applicant keeps on carving unflaggingly to develop a structure of a transformer according to the present invention through wholehearted experience and research.

SUMMARY OF THE INVENTION

It is an object of the present invention to provide a structure of a transformer for effectively controlling and increasing leakage inductance, enhancing electric safety.

It is another object of the present invention to provide a transformer, in which the transformer is simple in the structure, easily assembled and cost-effective.

In accordance with an aspect of the present invention, there is provided a transformer comprising a first winding member, a second winding member, a primary winding coil, a secondary winding coil and a magnetic core assembly. The first winding member has a first channel penetrating therethrough. The second winding member has a second channel penetrating therethrough and comprises a covering part. The covering part has a receptacle communicating with the second channel. The primary winding coil is wound on the first winding member. The secondary winding coil is wound on the second winding member. The magnetic core assembly is partially embedded into the first the second channels. The combination of the first winding member and the primary winding coil wound on the first winding member is accommodated within the receptacle, such that the primary winding coil and the secondary winding coil are separated from each other by the covering part and the first channel communicates with the second channel.

In accordance with another aspect of the present invention, there is provided a transformer comprising a first winding member, a second winding member, a third winding member, a primary winding coil, a first secondary winding coil, a second secondary winding coil and a magnetic core assembly. The first winding member has a first channel penetrating therethrough. The second winding member has a second channel penetrating therethrough and comprises first and second covering parts. The first and second covering parts have corresponding first and second receptacles communicating with the second channel. The third winding member has a third channel penetrating therethrough. The primary winding coil is wound on the first winding member. The first secondary winding coil is wound on the second winding member. The second secondary winding coil is wound on the third winding member. The magnetic core assembly partially embedded into the first, second and third channels. The combination of the first winding member and the primary winding coil wound on the first winding member is accommodated within the first receptacle. The combination of the third winding member and the second secondary winding coil wound on the third winding member is accommodated within the second receptacle. The primary winding coil, the first secondary winding coil and the second secondary winding coil are separated from each other by the first and second covering parts, and the first, second and third channels communicate with each other.

The above contents of the present invention will become more readily apparent to those ordinarily skilled in the art after reviewing the following detailed description and accompanying drawings, in which:

BRIEF DESCRIPTION OF THE DRAWINGS

FIG. 3(*b*) is a schematic cross-sectional view of the transformer of FIG. 3(*a*);

FIG. 3(*c*) is a schematic assembled view of the transformer of FIG. 3(*a*);

FIG. 3(*d*) is a schematic cross-section view of the transformer of FIG. 3(*c*) taken along the line A'A';

FIG. 4(*b*) is a schematic cross-sectional view of the transformer of FIG. 4(*a*);

FIG. 4(*c*) is a schematic assembled view of the transformer of FIG. 4(*a*); and FIG. 4(*d*) is a schematic cross-section view of the transformer of FIG. 4(*c*) taken along the line A'A'.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
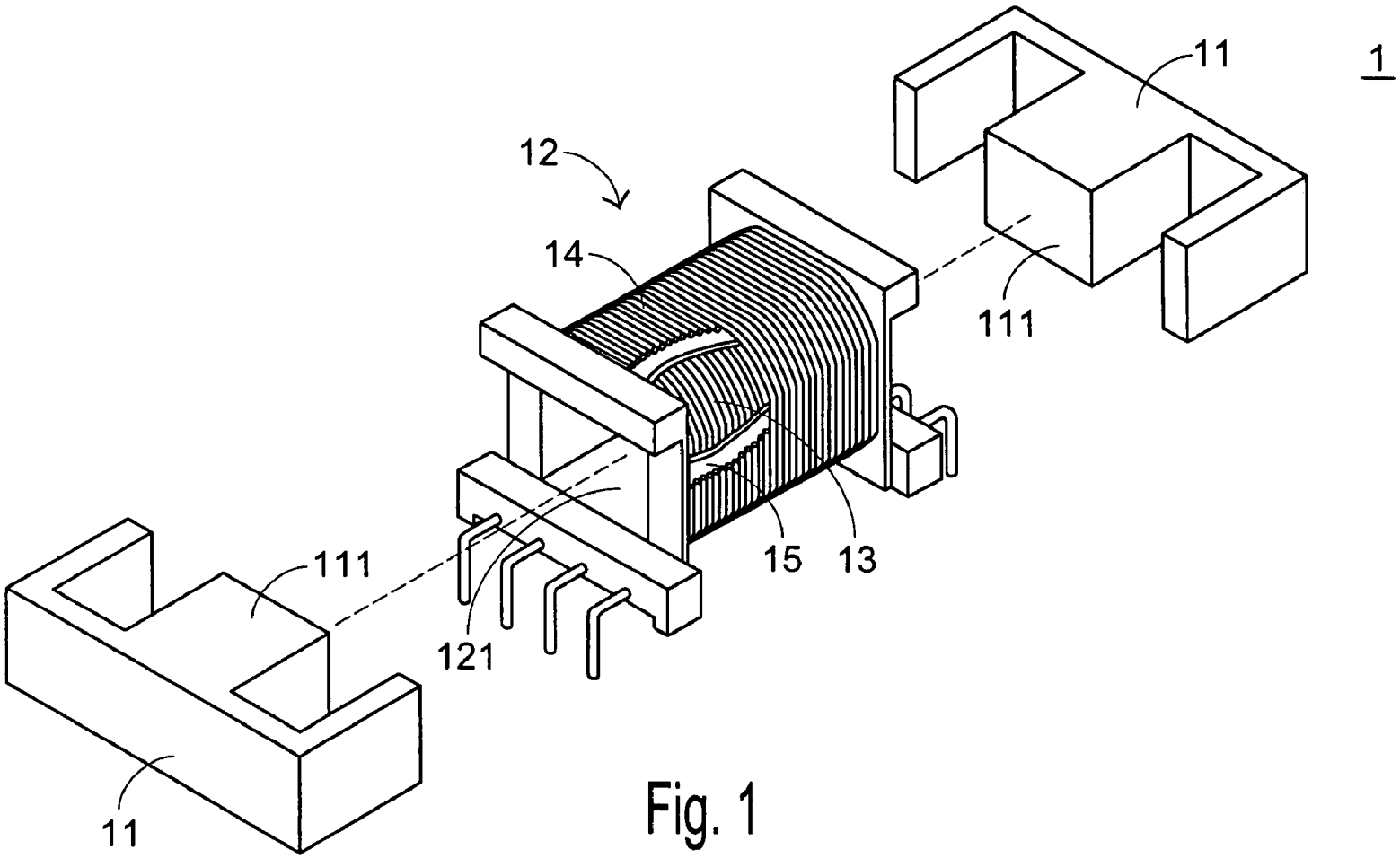
Fig. 1 PRIOR ART
FIG. 1 is a schematic exploded view of a conventional transformer.
Figure 2:
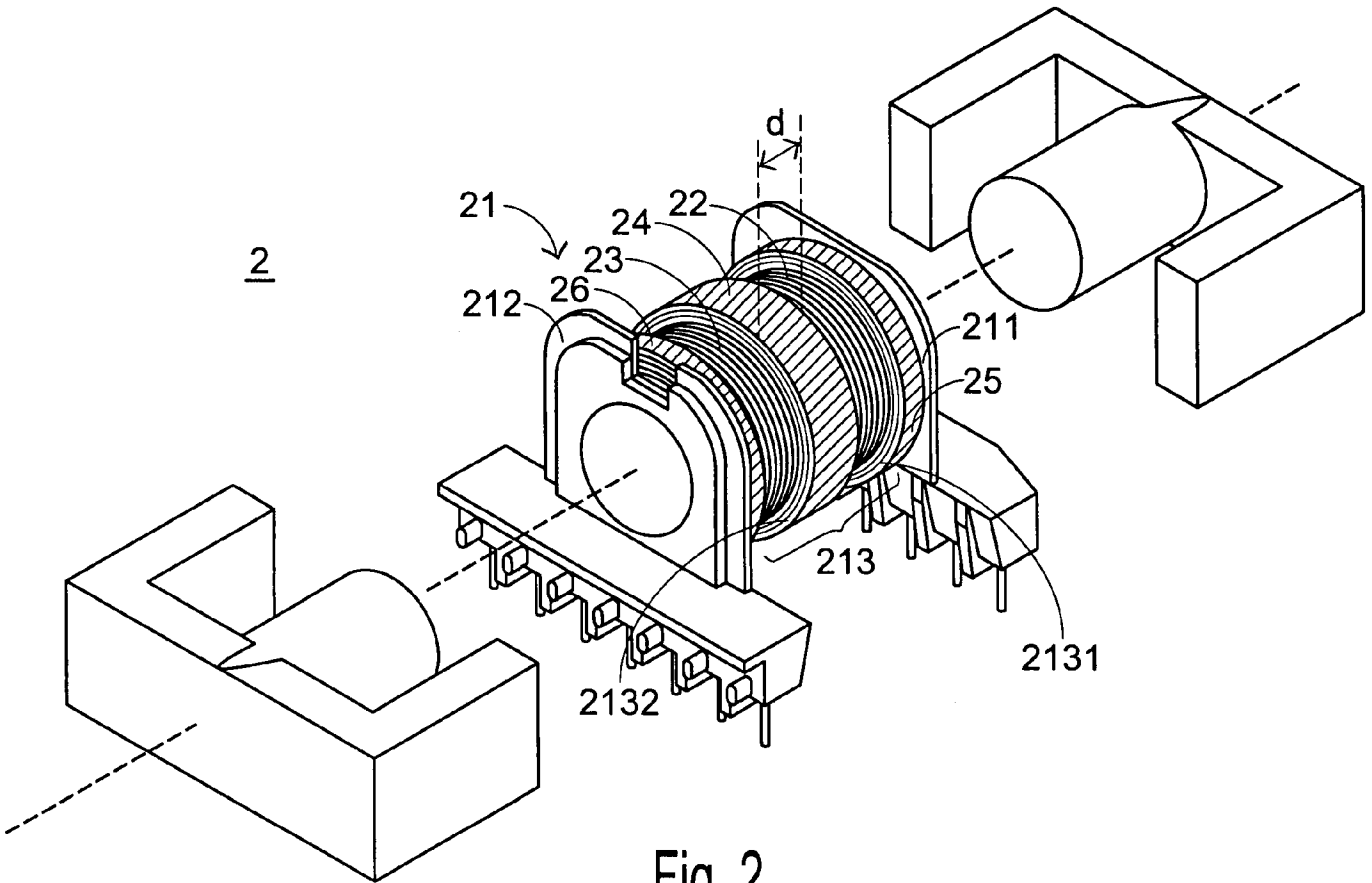
Fig. 2 PRIOR ART
FIG. 2 is a schematic exploded view of another conventional transformer.
Figure 3A:
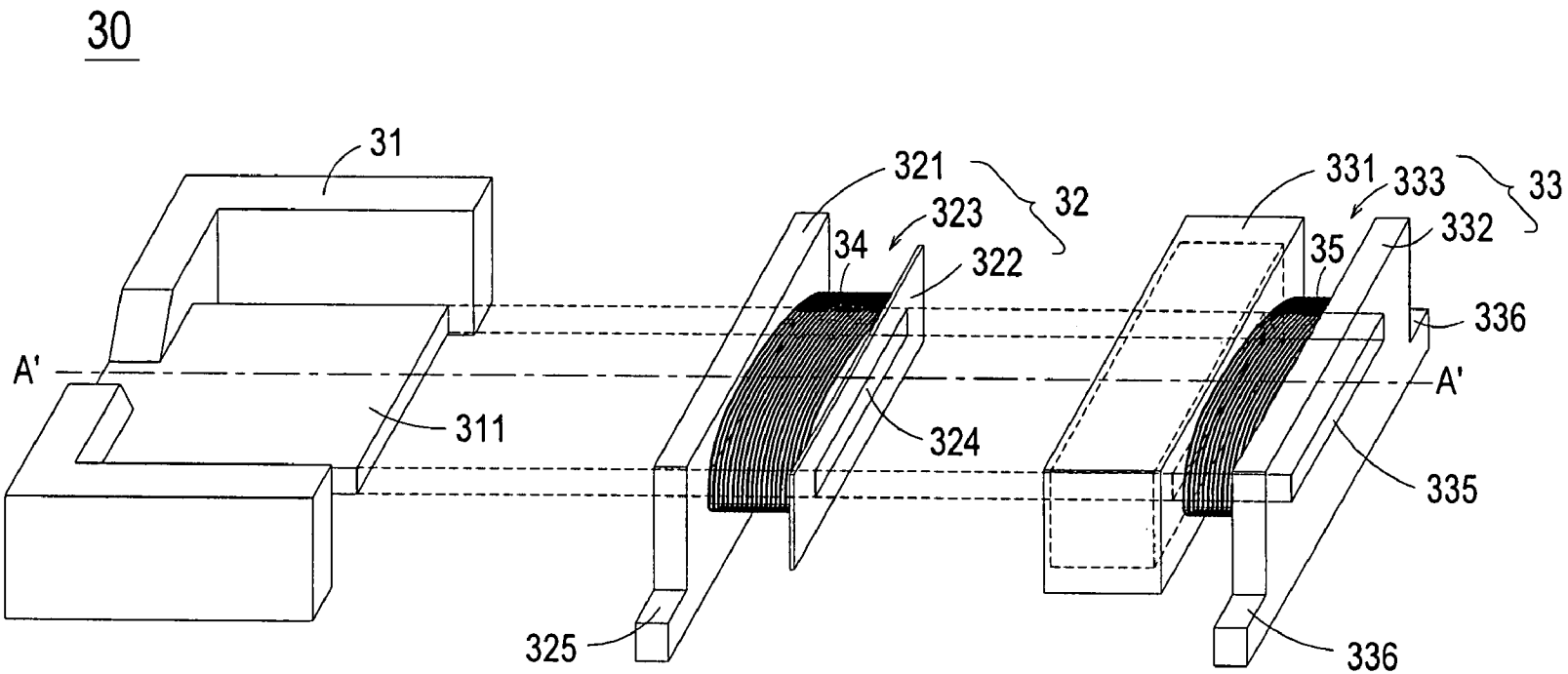
FIG. 3(*a*) is a schematic exploded view of a transformer according to a first preferred embodiment of the present invention.
Figure 3B:
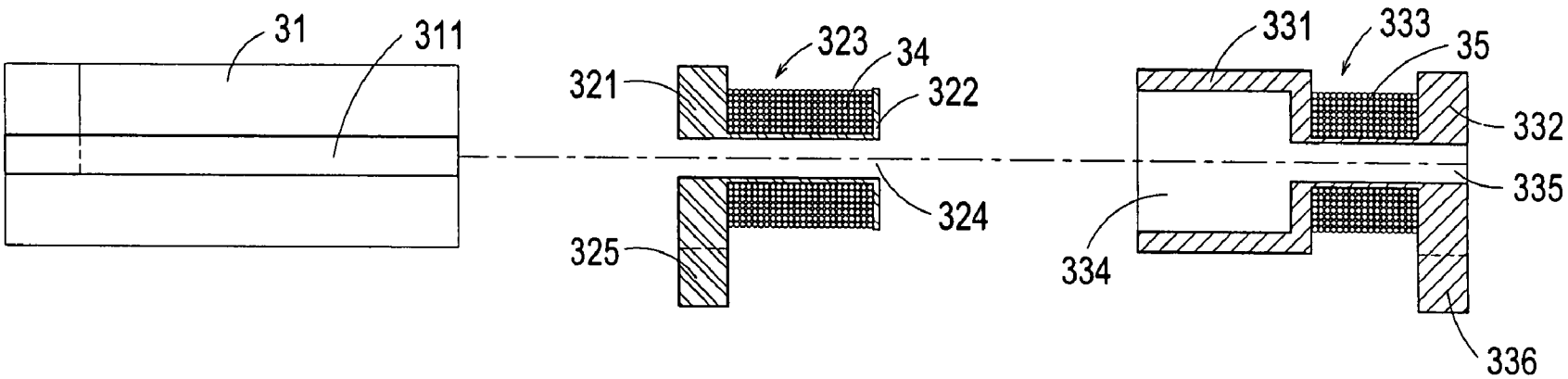
Figure 3D:
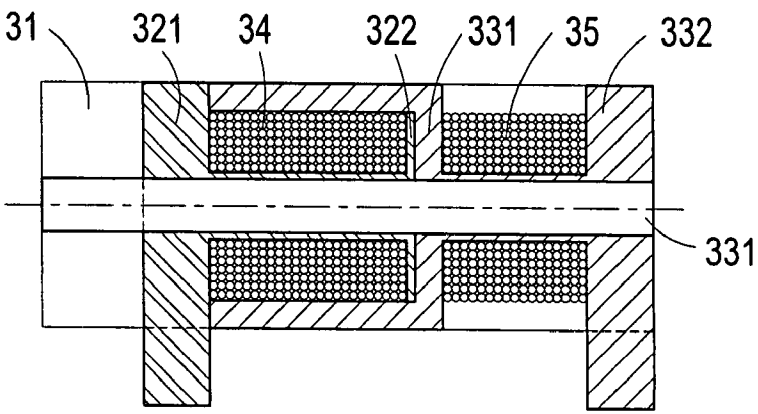
Figure 3C:
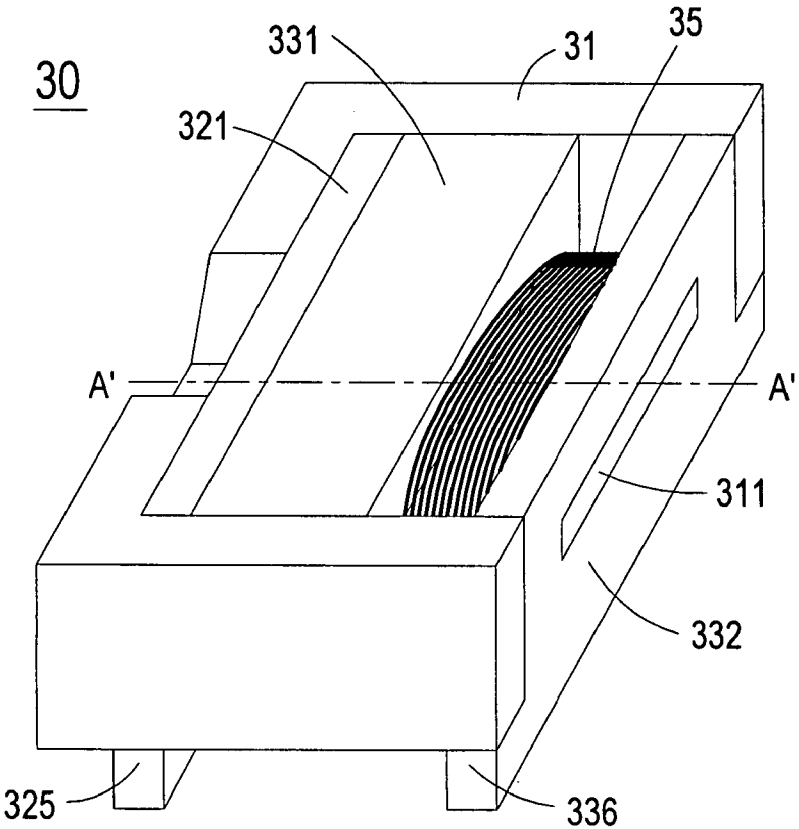

Referring to FIGS. 3(*a*) and 3(*b*), schematic exploded views of a transformer according to a first preferred embodiment of the present invention is illustrated. The transformer 30 principally comprises a magnetic core assembly 31, a first winding member 32, a second winding member 33, a primary winding coil 34 and a secondary winding coil 35. The magnetic core assembly 31 is generally shaped as an E-type core, EE-type core, an EI-type core or an ER-type core. The middle portions 311 of the magnetic core assembly 31 are embedded into the hollow portions of the first winding member 32 and the second winding member 33. The primary winding coil 34 and the secondary winding coil 35 interact with the magnetic core assembly 31 to achieve the purpose of voltage regulation.

The first winding member 32 comprises a first side plate 321, a second side plate 322, a first winding section 323 and a first channel 324. The primary winding coil 34 is wound around the first winding section 323 between the first side plate 321 and the second side plate 322. In this embodiment, the first side plate 321, the second side plate 322 and the first winding section 323 are integrally formed into one piece and the first channel 324 penetrates therethrough.

The second winding member 33 comprises a covering part 331, a third side plate 332, a second winding section 333 and a second channel 335. The secondary winding coil 35 is wound around the second winding section 333 between the covering part 331 and the third side plate 332. In this embodiment, the covering part 331, the second winding section 333 and the third side plate 332 are integrally formed into one piece. The covering part 331 has a receptacle 334 therein. The second channel 335 penetrates through the third side plate 332 and the second winding section 333, and communicates with the receptacle 334. The combination of the second side plate 322 and the primary winding coil 34 wound around the first winding section 323 is accommodated within the receptacle 334. Under this circumstance, the primary winding coil 34 and the secondary winding coil 35 are separated from each other by the covering part 331, and the first channel 324 communicates with the second channel 335. The resulting structure of the transformer is shown in FIGS. 3(*c*) and 3(*d*).

Please refer to FIGS. 3(*a*) and 3(*c*) again. The first side plate 321 of the first winding member 32 has an L-shaped supporting part 325 on each of the bilateral peripheries thereof. Likewise, the third side plate 332 of the second winding member 33 also has an L-shaped supporting part 336 on each of the bilateral peripheries thereof. After the middle portions 311 of the magnetic core assembly 31 are successively embedded into the first channel 324 and the second channel 335, the magnetic core assembly 31 is supported on the L-shaped supporting parts 325 of the first side plate 321 and the L-shaped supporting parts 336 of the third side plate 332.

In the above embodiment, since the primary winding coil 34 and the secondary winding coil 35 are separated from each other by the covering part 331, the coupling coefficient is reduced and the leakage inductance of the transformer is increased. In addition, the covering part 331 may isolate the conduction between the primary winding coil and the secondary winding coil. By the way, since no tape is used, the problem of using tapes for isolation will be overcome.

Figure 4A:
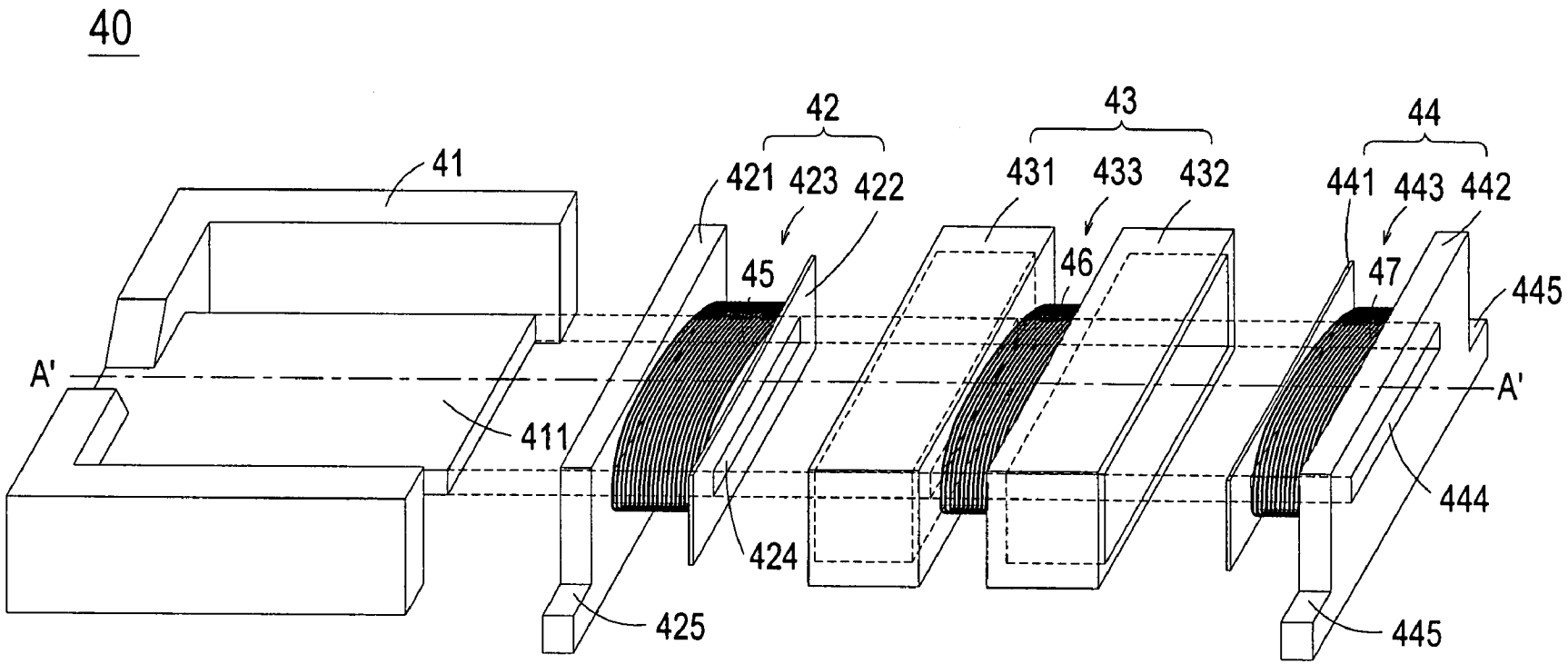
FIG. 4(*a*) is a schematic exploded view of a transformer according to a second preferred embodiment of the present invention.
Figure 4B:
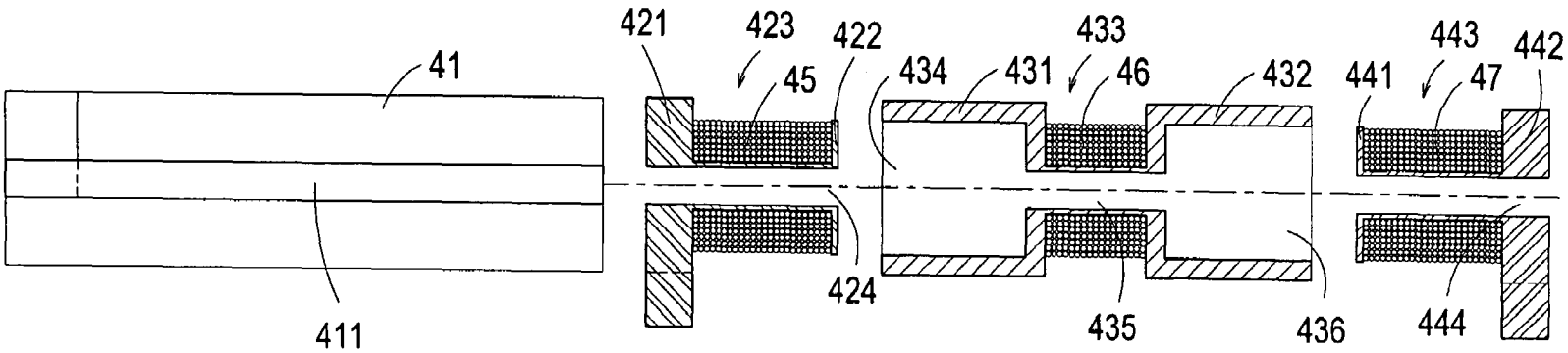
Figure 4C:
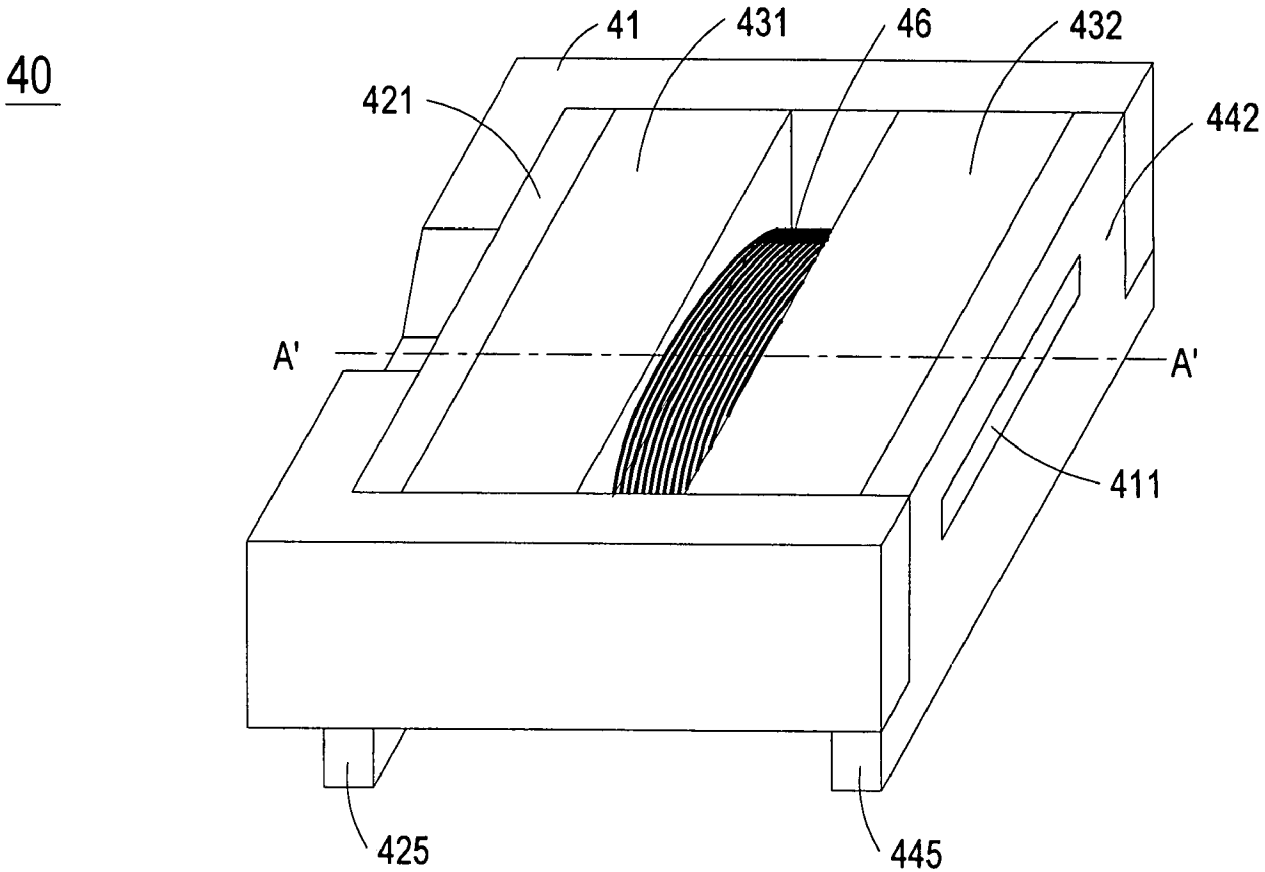
Figure 4D:
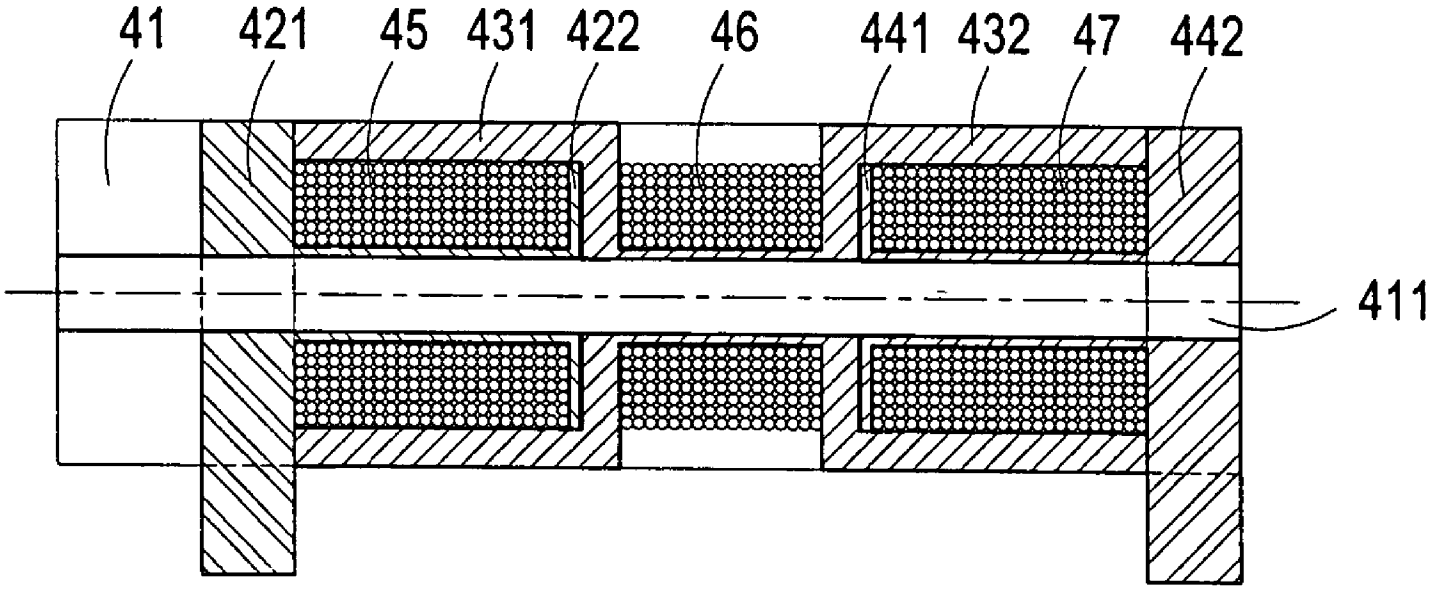

Referring to FIGS. 4(*a*) and 4(*b*), schematic exploded views of a transformer according to a second preferred embodiment of the present invention is illustrated. The transformer 40 principally comprises a magnetic core assembly 41, a first winding member 42, a second winding member 43, a third winding member 44, a primary winding coil 45, a first secondary winding coil 46 and a second secondary winding coil 47. The magnetic core assembly 41 is generally shaped as an E-type core, an EE-type core, a UU-type core, an EI-type core or an ER-type core. The middle portions 411 of the magnetic core assembly 41 are embedded into the hollow portions of the first winding member 42, the second winding member 43 and the third winding member 44. The primary winding coil 45, the first secondary winding coil 46 and the second secondary winding coil 47 interact with the magnetic core assembly 41 to achieve the purpose of voltage regulation.

In comparison with the transformer 30 shown in FIG. 3(*a*), the transformer 40 of this embodiment has an additional winding member so that the output voltage of the transformer 40 is increased to drive more electric products. For example, in a case that the output voltage provided by the transformer 30 of FIG. 3(*a*) is sufficient for operation of a lamp tube, the output voltage provided by the transformer 40 of this embodiment may drive two or more lamp tubes.

The first winding member 42 comprises a first side plate 421, a second side plate 422, a first winding section 423 and a first channel 424. The primary winding coil 45 is wound around the first winding section 423 between the first side plate 421 and the second side plate 422. In this embodiment, the first side plate 421, the second side plate 422 and the first winding section 423 are integrally formed into one piece and the first channel 424 penetrates therethrough.

The second winding member 43 comprises a first covering part 431, a second covering part 432, a second winding section 433 and a second channel 435. The first secondary winding coil 46 is wound around the second winding section 433 between the first covering part 431 and the second covering part 432. In this embodiment, the first covering part 431, the second winding section 433 and the second covering part 432 are integrally formed into one piece. The covering parts 431 and 432 have receptacles 434 and 436 therein, respectively. The second channel 435 penetrates through the second winding section 433, and communicates with the receptacles 434 and 436.

The third winding member 44 comprises a third side plate 441, a fourth side plate 442, a third winding section 443 and a third channel 444. The second secondary winding coil 47 is wound around the third winding section 443 between the third side plate 441 and the fourth side plate 442. In this embodiment, the third side plate 441 and the fourth side plate 442 and the third winding section 443 are integrally formed into one piece and the third channel 444 penetrates therethrough.

The combination of the second side plate 422 and the primary winding coil 45 wound around the first winding section 423 is accommodated within the receptacle 434. Under this circumstance, the primary winding coil 45 and the first secondary winding coil 46 are separated from each other by the first covering part 431, and the first channel 424 communicates with the second channel 435. Whereas, the combination of the third side plate 441 and the second secondary winding coil 47 wound around the third winding section 43 is accommodated within the receptacle 436. Under this circumstance, the second secondary winding coil 47 and the first secondary winding coil 46 are separated from each other by the second covering part 432, and the third channel 444 communicated with the second channel 435. The resulting structure of the transformer is shown in FIGS. 4(*c*) and 4(*d*).

Please refer to FIGS. 4(*a*) and 4(*c*) again. The first side plate 421 of the first winding member 42 has an L-shaped supporting part 425 on each of the bilateral peripheries thereof. Likewise, the fourth side plate 442 of the third winding member 44 also has an L-shaped supporting part 445 on each of the bilateral peripheries thereof. After the middle portions 411 of the magnetic core assembly 41 are successively embedded into the first channel 424, the second channel 435 and the third channel 444, the magnetic core assembly 41 is supported on the L-shaped supporting parts 425 of the first side plate 421 and the L-shaped supporting parts 445 of the fourth side plate 442.

In the above embodiment, since the primary winding coil 45, the first secondary winding coil 46 and the second secondary winding coil 47 are separated from each other by the covering parts 431 and 432, the coupling coefficient is reduced and the leakage inductance of the transformer is increased. In addition, the covering parts 431 and 432 may isolate the conduction between the primary winding coil and the secondary winding coil. By the way, since no tape is used, the problem of using tapes for isolation will be also overcome.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising:

a first winding member having a first channel penetrating therethrough;

a second winding member having a second channel penetrating therethrough and comprising a covering part at one side, said covering part having a receptacle communicating with said second channel;

a primary winding coil wound on said first winding member;

a secondary winding coil wound on said second winding member; and a magnetic core assembly partially embedded into said first and said second channels, wherein the combination of said first winding member and said primary winding coil wound on said first winding member is accommodated within said receptacle, such that said primary winding coil and said secondary winding coil are horizontally separated from each other by said covering part and said first channel communicates with said second channel.

2. The transformer according to claim 1 wherein said first winding member further comprises a first side plate, a second side plate and a first winding section, and said primary winding coil is wound around said first winding section between said first side plate and said second side plate.

3. The transformer according to claim 2 wherein said first side plate, said second side plate and said first winding section are integrally formed into one piece, and said first channel penetrates therethrough.

4. The transformer according to claim 3 wherein the combination of said first side plate and said primary winding coil wound around said first winding section is accommodated within said receptacle of said covering part.

5. The transformer according to claim 4 wherein said winding member further comprises a third side plate and a second winding section, and said secondary winding coil is wound around said second winding section between said third side plate and said covering part.

6. The transformer according to claim 5 wherein said covering part, said second winding section and said third side plate are integrally formed into one piece, and said second channel penetrates through said second winding section and said third side plate.

7. The transformer according to claim 6 wherein each of said first side plate of said first winding member and said third side plate of said second winding member has an L-shaped supporting part on each of the bilateral peripheries thereof so as to support said magnetic core assembly thereon.

8. The transformer according to claim 1 wherein said magnetic core assembly is generally shaped as an E-type core, an EL-type core, a UU-type core, an LI-type core or an ER-type core.

9. The transformer according to claim 1 wherein the middle portions of said magnetic core assembly are embedded into said first and second channels.

10. A transformer comprising:

a first winding member having a first channel penetrating therethrough;

a second winding member having a second channel penetrating therethrough and comprising first and second covering parts at two sides, said first and second covering parts having corresponding first and second receptacles communicating with said second channel;

a third winding member having a third channel penetrating therethrough;

a primary winding coil wound on said first winding member;

a first secondary winding coil wound on said second winding member;

a second secondary winding coil wound on said third winding member; and a magnetic core assembly partially embedded into said first, second and third channels, wherein the combination of said first winding member and said primary winding coil wound on said first winding member is accommodated within said first receptacle, and the combination of said third winding member and said second secondary winding coil wound on said third winding member is accommodated within said second receptacle, such that said primary winding coil, said first secondary winding coil and said second secondary winding coil are horizontally separated from each other by said first and second covering parts, and said first, second and third channels communicate with each other.

11. The transformer according to claim 10 wherein said first winding member further comprises a first side plate, a second side plate and a first winding section, and said primary winding coil is wound around said first winding section between said first side plate and said second side plate.

12. The transformer according to claim 11 wherein said first side plate, said second side plate and said first winding section are integrally formed into one piece, and said first channel penetrates therethrough.

13. The transformer according to claim 12 wherein the combination of said first side plate and said primary winding coil wound around said first winding section is accommodated within said first receptacle of said first covering part.

14. The transformer according to claim 13 wherein said second winding member further comprises a second winding section between said first and second covering parts, and said first secondary winding coil wound around said second winding section.

15. The transformer according to claim 14 wherein said first covering part, said second winding section and said second covering plate are integrally formed into one piece, and said second channel penetrates through said second winding section and communicates with said first and second receptacles.

16. The transformer according to claim 15 wherein said third winding member further comprises a third side plate, a fourth side plate and a third winding section, and said second secondary winding coil is wound around said third winding section between said third side plate and said fourth side plate.

17. The transformer according to claim 16 wherein said third side plate, said fourth side plate and said third winding section are integrally formed into one piece, and said third channel penetrates therethrough.

18. The transformer according to claim 17 wherein each of said first side plate of said first winding member and said fourth side plate of said third winding member has an L-shaped supporting part on each of the bilateral peripheries thereof so as to support said magnetic core assembly thereon.

19. The transformer according to claim 10 wherein said magnetic core assembly is generally shaped as an E-type core, an EL-type core, a UU-type core, an LI-type core or an ER-type core.

20. The transformer according to claim 10 wherein the middle portions of said magnetic core assembly are embedded into said first, second and third channels.

* * * * *